US008226190B2

(12) United States Patent
Hirayama et al.

(10) Patent No.: US 8,226,190 B2
(45) Date of Patent: Jul. 24, 2012

(54) RECORDING ELEMENT SUBSTRATE AND RECORDING HEAD HAVING THE SAME

(75) Inventors: Nobuyuki Hirayama, Fujisawa (JP); Tatsuo Furukawa, Zama (JP); Masataka Sakurai, Kawasaki (JP); Ryo Kasai, Tokyo (JP); Tomoko Kudo, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 419 days.

(21) Appl. No.: 12/626,096

(22) Filed: Nov. 25, 2009

(65) Prior Publication Data

US 2010/0134543 A1 Jun. 3, 2010

(30) Foreign Application Priority Data

Dec. 1, 2008 (JP) ..... 2008-306503

(51) Int. Cl.
*B41J 29/38* (2006.01)
*B41J 2/05* (2006.01)

(52) U.S. Cl. ..... 347/9; 347/10; 347/11; 347/57; 347/58; 347/59

(58) Field of Classification Search ..... 347/5, 9–12, 347/57–59
See application file for complete search history.

(56) References Cited

U.S. PATENT DOCUMENTS 4,825,102 A * 4/1989 Iwasawa et al. ..... 327/546
7,806,496 B2 * 10/2010 Sakurai ..... 347/9
2001/0045968 A1 11/2001 Hirayama

FOREIGN PATENT DOCUMENTS

JP 2001-277516 A 10/2001

* cited by examiner

*Primary Examiner* — Jason Uhlenhake
(74) *Attorney, Agent, or Firm* — Canon USA Inc IP Division

(57) ABSTRACT

A recording element substrate includes a recording element, a first voltage conversion circuit configured to receive a first control signal and to output the first control signal with an increased amplitude, a second voltage conversion circuit configured to receive a second control signal and to output the second control signal with an increased amplitude, a PMOS transistor connected to one end of the recording element, and an NMOS transistor connected to the other end of the recording element, wherein the PMOS transistor has a gate connected to an output of the first voltage conversion circuit, and the NMOS transistor has a gate connected to an output of the second voltage conversion circuit.

7 Claims, 19 Drawing Sheets

RECORDING ELEMENT SUBSTRATE AND RECORDING HEAD HAVING THE SAME

BACKGROUND OF THE INVENTION

1. Field of the Invention

The present invention relates to a recording element substrate having a plurality of recording elements, and a recording head having the recording element substrate.

2. Description of the Related Art

For printing at a higher speed using a recording head, simultaneous driving of as many heaters (recording elements) as possible are desirable. Such driving, however, increases a current flowing through line (wiring). This may preclude the generation of desired thermal energy at the heaters due to voltage drop caused by parasitic resistance of the line (wiring). The variation in thermal energy leads to variable volumes of discharged ink, resulting in the problem of degraded image quality. To solve the problem, Japanese Patent Application Laid-Open No. 2001-277516 discusses a device in which a recording element substrate having a control circuit 1801 and a selection circuit 1802 controls the voltage across a heater R1 to be equal to that of a constant voltage generator Vr1. This circuit configuration maintains the thermal energy at the heater to be constant regardless of any voltage fluctuation, and stabilizes the volume of discharged ink droplets.

In the device discussed in Japanese Patent Application Laid-Open No. 2001-277516, the voltage fluctuation in one of a high-potential or low-potential power wiring is controlled to apply a constant voltage to a heater. The other power wiring for the heater is, however, only designed to have a wiring resistance that is suppressed enough for negligible voltage fluctuation.

Power lines (wirings) used on a substrate are getting narrower and longer and, thus, have an increased resistance than that of a conventional wire. This increases the voltage fluctuation in the power wiring to a non-negligible level.

SUMMARY OF THE INVENTION

According to an aspect of the present invention, a recording element substrate includes a recording element; a first power line configured to supply a first voltage; a second power line configured to supply a ground voltage; a first voltage conversion circuit including a first input unit configured to receive a first control signal, and a second input unit configured to receive a second voltage, which is higher than the ground voltage, and the first voltage, and to output the first control signal with an increased amplitude; a second voltage conversion circuit including a first input unit configured to receive a second control signal, and a second input unit configured to receive a third voltage, which is lower than the first voltage, and the ground voltage, and to output the second control signal with an increased amplitude; a PMOS transistor having a drain terminal connected to the first power line, a source terminal connected to one end of the recording element, and a gate terminal connected to an output of the first voltage conversion circuit; and an NMOS transistor having a drain terminal connected to the second power line, a source terminal connected to the other end of the recording element, and a gate terminal connected to an output of the second voltage conversion circuit.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

In the context of the present specification, the term "substrate" as used in "on a/the substrate" includes an element substrate surface and inside of the element substrate near the surface as well as the substrate. The term "same substrate" does not mean that a plurality of elements are simply disposed on a substrate, but indicates that the elements are integrally formed, manufactured, and arranged on the element substrate in steps for manufacturing semiconductor circuits.

Figure 1:
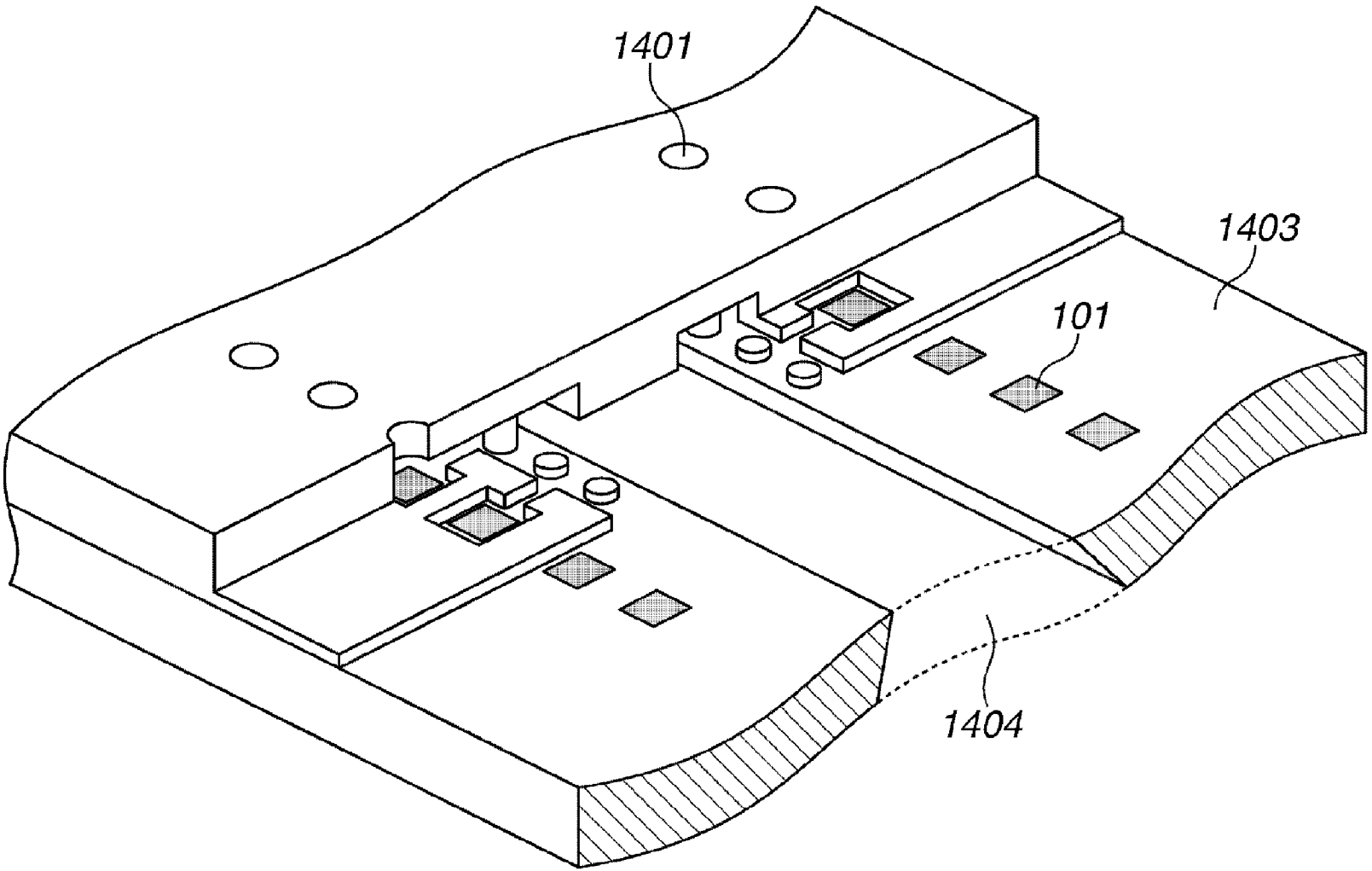
FIG. 1 is a cross sectional view illustrating a recording element substrate according to an exemplary embodiment of the present invention.

FIG. 1 illustrates a part of a recording head according to an exemplary embodiment of the present invention with a cross section of a substrate with nozzles. A substrate 1403 is provided with an ink supply port 1404, and has heaters 101 and nozzles 1401 formed on an upper surface thereof. Ink is fed from a lower surface of the substrate 1403 through the ink supply port 1404 to upper surfaces of the heaters 101. The fed ink is heated by the heaters 101, and bubbles, resulting in discharge of the ink through the nozzles 1401.

Figure 7:
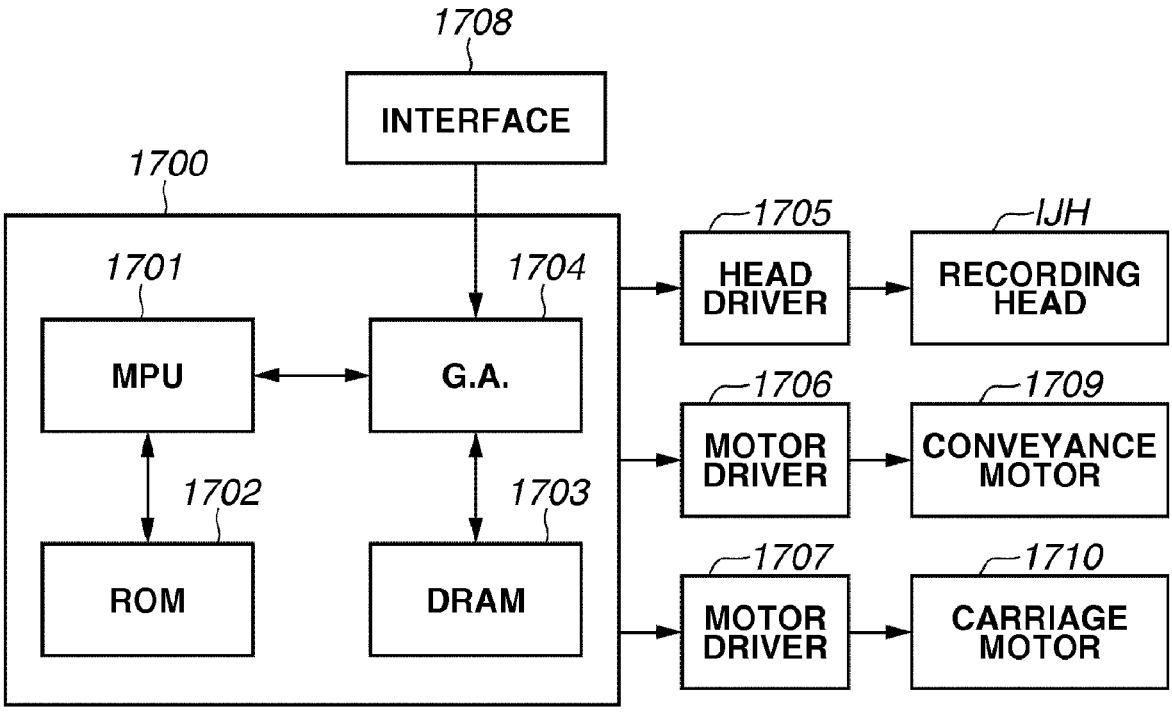
FIG. 7 is a block diagram illustrating a configuration of a controller in a recording apparatus according to an exemplary embodiment of the present invention.

FIG. 7 is a block diagram illustrating a configuration of a controller 1700 of a recording apparatus according to an exemplary embodiment of the present invention.

A micro processing unit (MPU) 1701 controls the recording apparatus according to a control program stored in a read only memory (ROM) 1702. A dynamic random access memory (DRAM) 1703 stores data and parameters processed by the control. Signals from an external device are input through an interface 1708. Agate array (G.A.) 1704 controls a head driver 1705 and motor drivers 1706 and 1707, and transfers signals and data. The head driver 1705 drives a recording head IJH, the motor driver 1706 drives a conveyance motor 1709, and the motor driver 1707 drives a carriage motor 1710.

Figure 2:
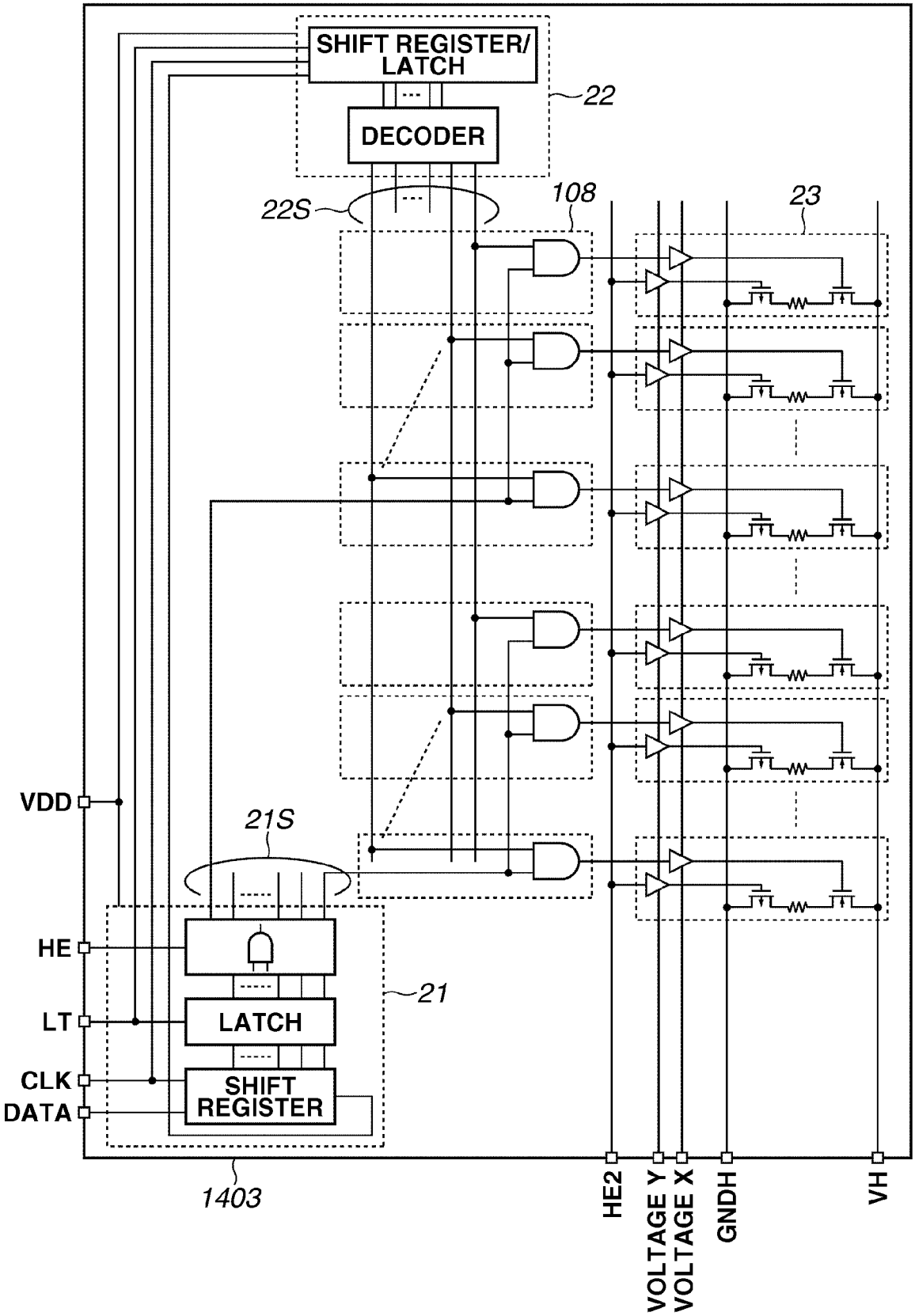
FIG. 2 is a block diagram illustrating a recording element substrate according to a first exemplary embodiment of the present invention.

FIG. 2 is a block diagram illustrating a circuit configuration of a recording element substrate according to a first exemplary embodiment of the present invention. The circuit configuration is arranged on the substrate 1403 in FIG. 1. The substrate 1403 is provided with a record data supply circuit 21 and a block selection circuit 22 for processing logical signals input from an external device, the circuits outputting record data signals 21S and block selection signals 22S, respectively. In response to input record data (DATA), signals are transmitted to each of record data signal lines, so that the block selection signals 22S sequentially select blocks to be driven. A selection circuit (logical circuit) 108 performs logic operations on the record data signal 21S and the block selection signal 22S, and outputs the operation results to a recording element driving circuit 23.

A clock signal (CLK), record data (DATA), a latch signal (LT), and enable signals (HE1 and HE2) are generated by the controller 1700 in FIG. 7, and input to the substrate 1403. A voltage VDD (e.g., 3.3 volts), a voltage X, a voltage Y, and a voltage VH (e.g., 24 volts) are supplied from a power source circuit of the recording apparatus or the head driver 1705. The voltage VDD is supplied to the record data supply circuit 21, the block selection circuit 22, and the selection circuit 108. The record data supply circuit 21, the block selection circuit 22, and the selection circuit 108 output signals having a voltage VDD.

Figure 3:
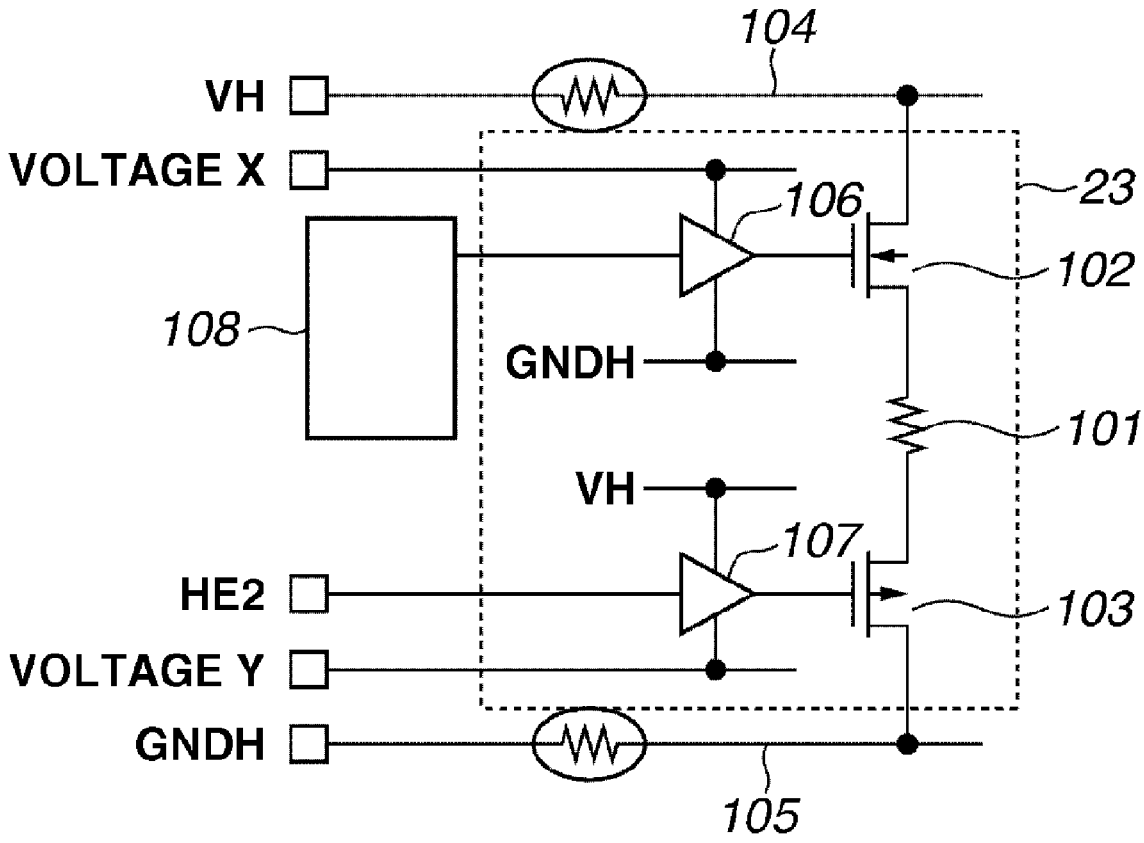
FIG. 3 illustrates a recording element driving circuit according to the first exemplary embodiment

FIG. 3 illustrates a recording element driving circuit 23. In FIG. 3, for simplicity of description, only the circuit of one of the heaters 101 is illustrated. The heater 101 has one end connected to a source terminal of an NMOS transistor 102, and the other end connected to a source terminal of a PMOS transistor 103. The NMOS transistor 102 and the PMOS transistor 103 each have a drain terminal connected to a power line (wiring) 104 and a power line (wiring) 105, respectively. The power lines (wirings) 104 and 105 are connected to external sources via input terminals of the recording element substrate, and applied with a high-potential voltage VH and a low-potential voltage GNDH, respectively. The potentials are input via the input terminals from the external sources for the voltage VH applied to a high-voltage line (wiring) and the voltage GNDH applied to a low-voltage line (wiring). The recording element driving circuit 23 includes two voltage conversion circuits 106 and 107. The voltage conversion circuit 106 relays signals between the selection circuit 108 and a gate of the NMOS transistor 102, whereas the voltage conversion circuit 107 relays signals HE2 to a gate to the PMOS transistor 103. The voltage conversion circuits 106 and 107 may relay signals generated by other circuits.

Figure 4A:
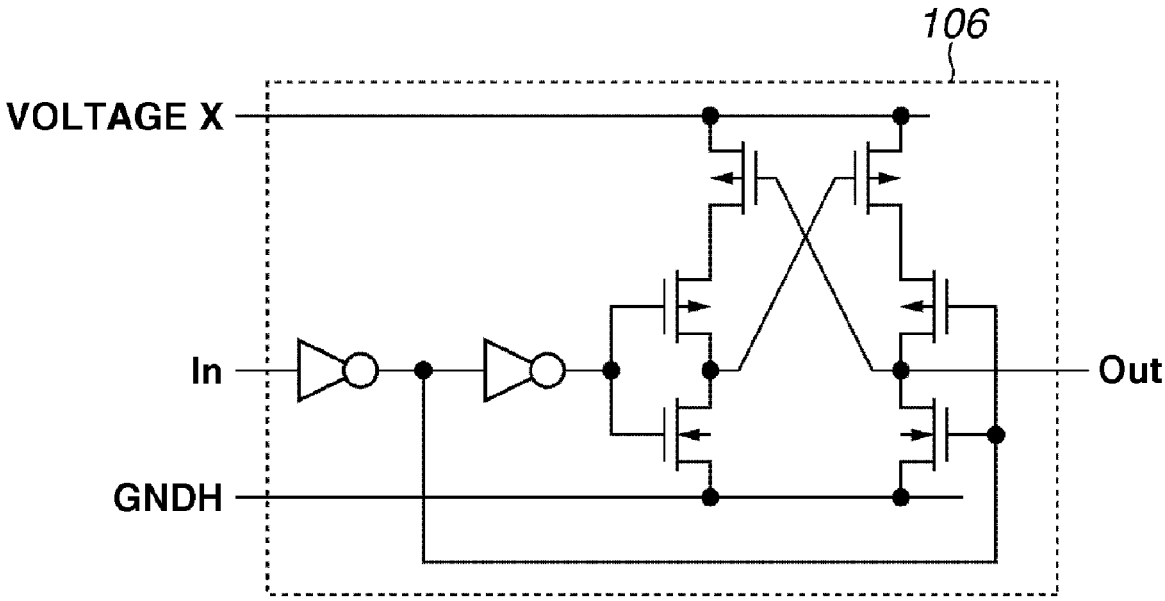
FIGS. 4A and 4B are block diagrams illustrating a voltage conversion circuit according to the first exemplary embodiment.

FIG. 4A illustrates a configuration of the voltage conversion circuit 106. The voltage conversion circuit 106 receives a voltage X and a voltage GNDH, and modulates the amplitudes of input signals. The voltage conversion circuit 106 generates a gate voltage to turn on the NMOS transistor 102 based on the voltage X from an external source of the recording element substrate. The voltage X is different from the power source voltage GNDH supplied to the drain of the PMOS transistor 103 from an external source of the recording element substrate.

Figure 4B:
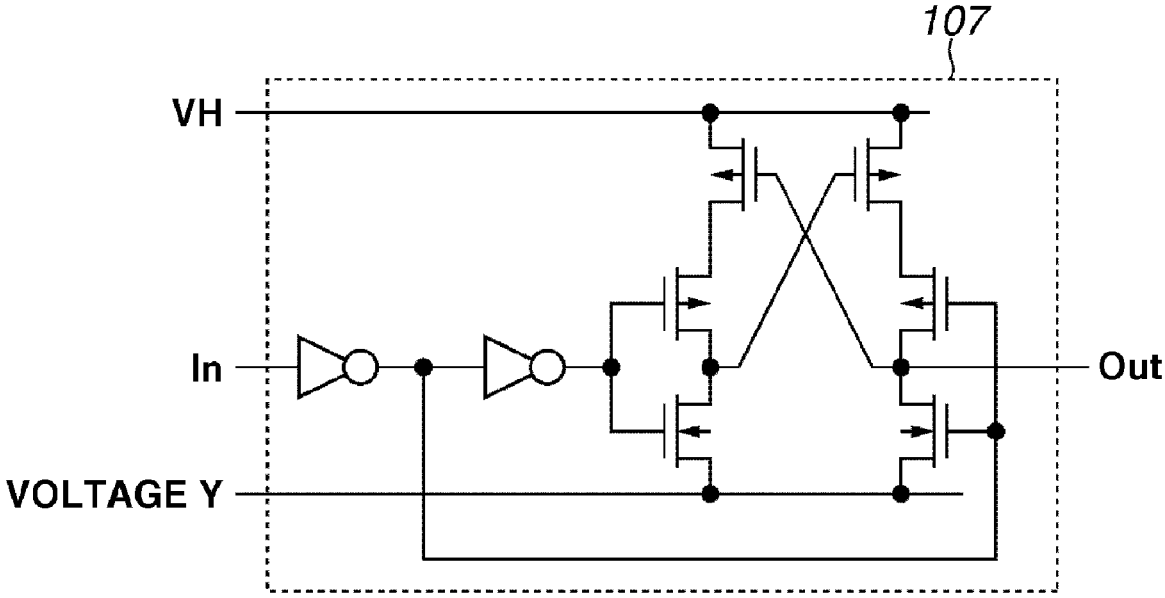

FIG. 4B illustrates a configuration of the voltage conversion circuit 107. The voltage conversion circuit 107 receives a voltage Y and a voltage VH, and modulates the amplitudes of input signals. The voltage conversion circuit 107 generates a gate voltage to turn on the PMOS transistor 103 based on the voltage Y from an external source of the recording element substrate. The voltage Y is different from the power source voltage VH supplied to the drain of the NMOS transistor 102.

The gate voltage required to turn on the PMOS transistor 103 and the gate voltage required to turn on the NMOS transistor 102 are determined based on the power source voltage VH supplied to the drain of the NMOS transistor 102 or the power source voltage GNDH supplied to the drain of the PMOS transistor 103. The selection circuit 108 outputs a signal corresponding to image data to the voltage conversion circuit 106. The voltage conversion circuit 106 converts the input signal into a drive voltage for the NMOS transistor 102, whereas the voltage conversion circuit 107 converts the input signal into a drive voltage for the PMOS transistor 103.

Figure 5:
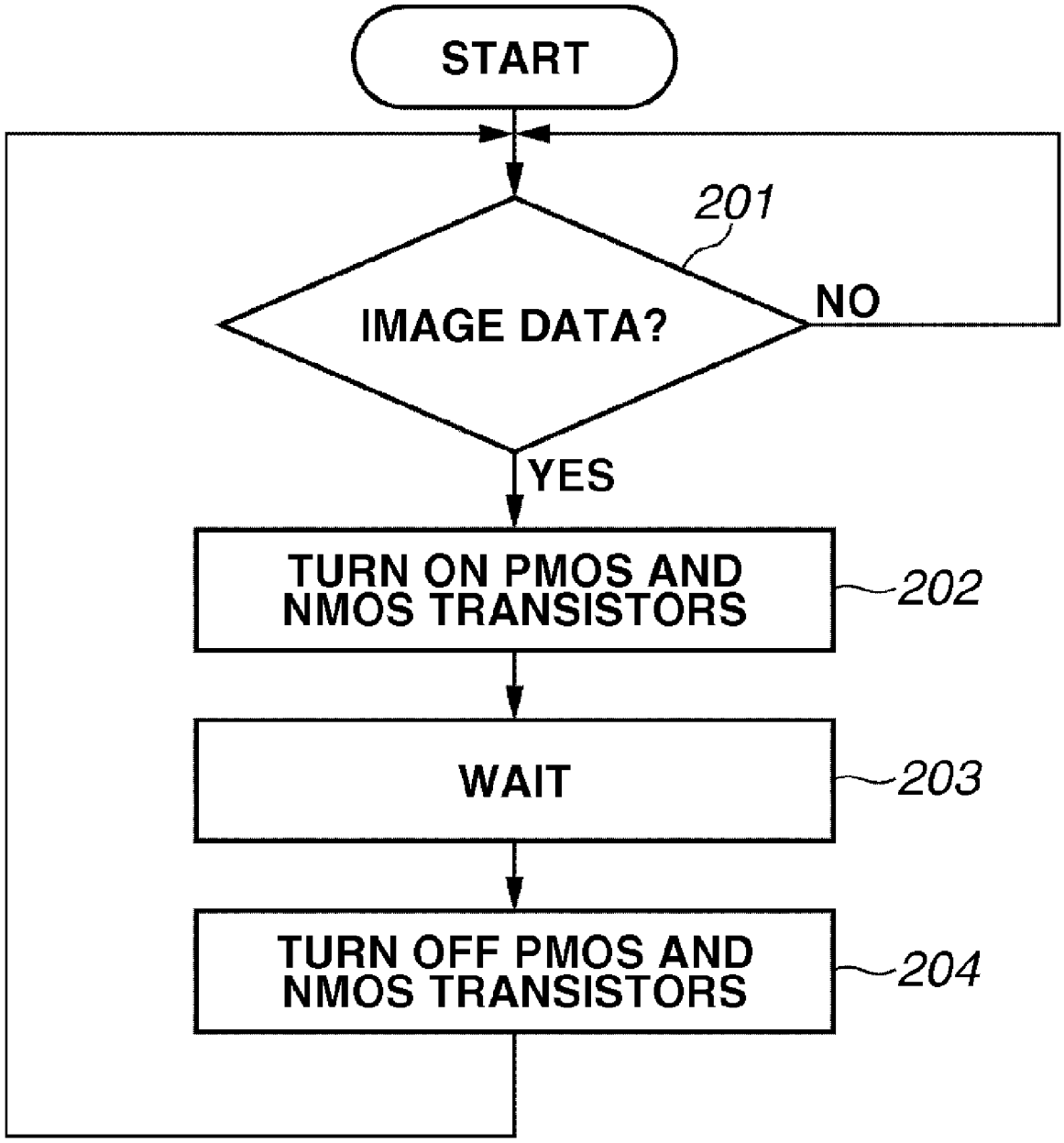
FIG. 5 is a flow chart illustrating processing for driving a heater according to the first exemplary embodiment.
Figure 6A:
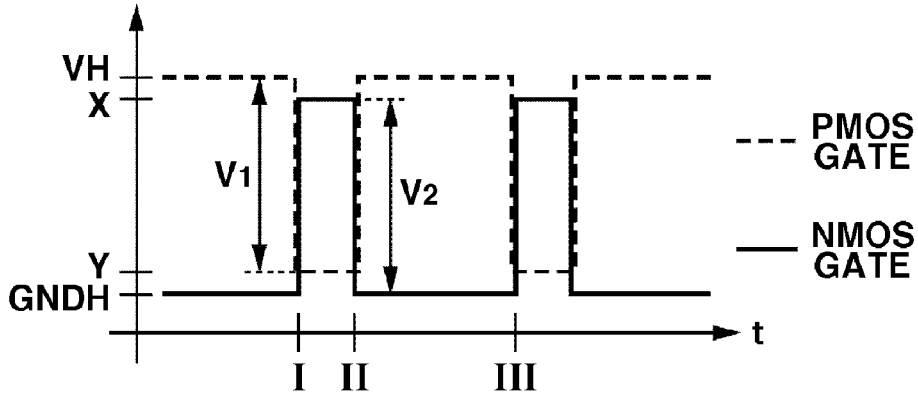
FIGS. 6A to 6C are timing charts illustrating the potentials of heaters and a current applied to a heater according to the first exemplary embodiment.
Figure 6B:
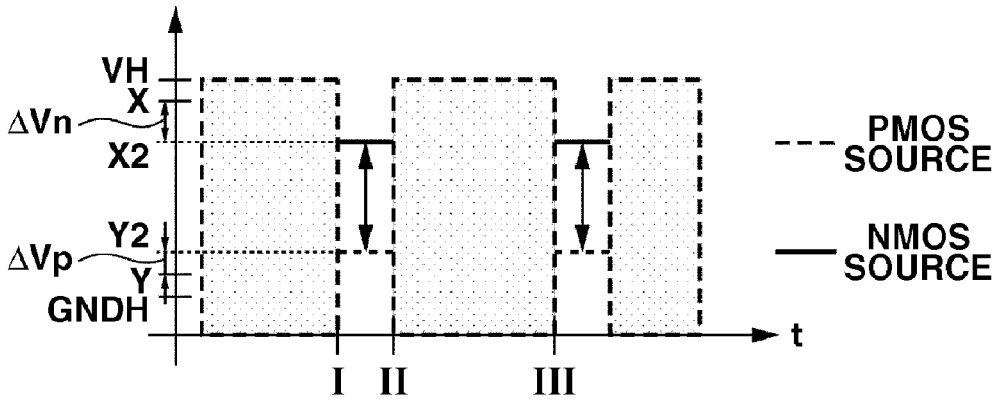

The circuit in FIG. 3 is now described below with reference to the flow chart in FIG. 5. FIGS. 6A and 6B are timing charts for the processing in FIG. 5. In step 201, the selection circuit 108 determines data corresponding to a heater to be driven. In step 202, for data "1", the selection circuit 108 turns on the NMOS transistor 102 and the PMOS transistor 103. More specifically, the NMOS transistor 102 is turned on based on the signals 21S and 22S, whereas the PMOS transistor 103 is turned on based on the signal HE2. The PMOS transistor 103 can be turned on while the signal HE2 is enabled. This drives the heater. In step 203, the selection circuit 108 enters a wait state for a predetermined period of time. In step 204, the selection circuit 108 turns off both of the transistors 102 and 103. This ends the driving of the heater 101, which causes ink to be discharged through the nozzle 1401.

Figure 6C:
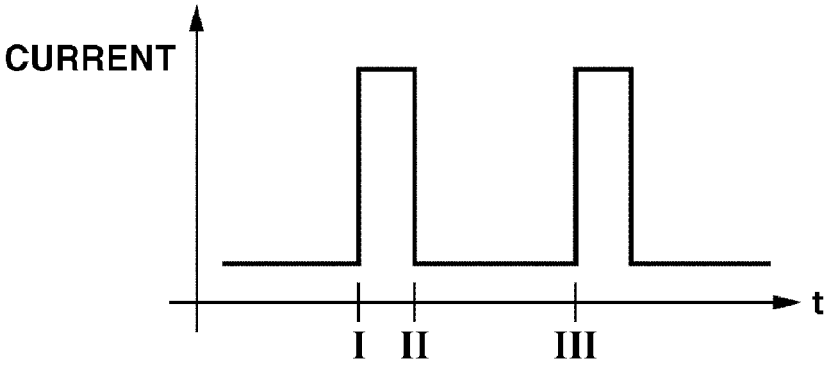

FIG. 6A illustrates waveforms of voltages applied to the gates of the NMOS transistor 102 and the PMOS transistor 103. FIG. 6B illustrates waveforms of voltages applied to the source terminals of the NMOS transistor 102 and the PMOS transistor 103. FIG. 6C illustrates a current flowing through the heater 101.

In FIG. 6A, the waveform of a voltage applied to the gate of the NMOS transistor 102 is illustrated by the solid line, whereas the waveform of a voltage applied to the gate of the PMOS transistor 103 is illustrated by the dashed line. Before the timing I, the NMOS transistor 102 has a gate voltage GNDH, and the PMOS transistor 103 has a gate voltage VH. In this state, both of the transistors 102 and 103 are in off-state, and the heater 101 is not driven. At the timing I, a gate voltage Y is applied to turn on the PMOS transistor 103, whereas a gate voltage X is applied to turn on the NMOS transistor 102. This on-state allows a current to flow and drive the heater 101. The heater 101 is driven during the period (of time) when both of the transistors 102 and 103 are in on-state. At the timing II, a gate voltage GNDH instead of the gate voltage X is applied to the NMOS transistor 102, whereas a gate voltage VH instead of the gate voltage Y is applied to the PMOS transistor 103, so that both of the transistors 102 and 103 are turned off, which interrupt the current flow to the heater 101. The voltage Y is set so that the potential difference V1 between the voltages Y and VH applied to the PMOS transistor 103 exceeds a threshold voltage required to turn on the PMOS transistor 103. The voltage X is set so that the potential difference V2 between the voltages X and GNDH applied to the NMOS transistor 102 exceeds a threshold voltage required to turn on the NMOS transistor 102.

In FIG. 6B, before the timing I, both of the transistors 102 and 103 are in off-state, and the heaters 101 is not energized. When data is input to drive the heater 101, during the period between the timings I and II, the voltages X and Y are input to the transistors 102 and 103, respectively, so that the transistors 102 and 103 are turned on, which allow a current flow to the heater 101. The NMOS transistor 102 has characteristics that, when the gate of the NMOS transistor 102 is applied with the voltage X, the source of the NMOS transistor 102 is applied with a voltage X2 smaller than the gate voltage X by a predetermined voltage ($\Delta Vn$). Accordingly, the voltage X2 is applied to an NMOS transistor-side terminal of the heater 101. The PMOS transistor 103 has characteristics that, when the gate of the PMOS transistor 103 is applied with the voltage Y, the source of the PMOS transistor 103 is applied with a voltage Y2 larger than the gate voltage Y by a predetermined voltage ($\Delta Vp$). Accordingly, the voltage Y2 is applied to a PMOS transistor-side terminal of the heater 101.

The heater 101 connected to the source of the NMOS transistor 102 at one end thereof and to the source of the PMOS transistor 103 at the other end thereof is applied with a source voltage of the NMOS transistor 102 at the one end and a source voltage of the PMOS transistor 103 at the other end. The actual current flowing through the heater 101 is determined by a drain-source voltage Vds of each of the NMOS transistor 102 and the PMOS transistor 103. The voltage Vds is applied between the drain and the source of each of the transistors 102 and 103 in current saturation. At the timing II, the NMOS transistor 102 having the gate voltage GNDH and the PMOS transistor 103 having the gate voltage VH are turned off, which interrupt the current flow to the heater 101. FIG. 6C illustrates a waveform of a current flowing through the heater 101. The current flows through the heater 101 during the period between the timings I and II when the NMOS transistor 102 and the PMOS transistor 103 are in on-state.

In FIG. 6B, the voltage applied to the heater 101 during the period between the timings I and II is designated by the arrow. In terms of the source voltage of each MOS transistor at the transition point of the current flowing through the heater 101, the transistor between the source and the drain is switched between an open state and a state supplied with a predetermined power (a constant potential) before and after the timings I and II, as described above. As illustrated in FIG. 6B, since the source voltage of each transistor may significantly change at the transition point of the current to drive the heater 101, the MOS transistor needs to have a high source-drain voltage in the case that a high power source voltage (VH) is applied to the heater 101. Accordingly, both of the NMOS transistor 102 and the PMOS transistor 103 require high-voltage-proof devices.

As described above, during the period between the timings I and II when the heater is energized, the voltage X is applied to the gate of the NMOS transistor 102 and the voltage Y is applied to the gate of the PMOS transistor 103. At this application, the NMOS transistor 102 connected to the heater 101 at the source thereof is operated as a source follower, and a voltage shifted from the gate voltage by a predetermined amount is applied to the heater 101 at the source terminal of the NMOS transistor 102. The heater 101 connected to the source terminal of the PMOS transistor 103 at the other end thereof is applied with a voltage shifted from the gate voltage Y of the PMOS transistor 103 by a predetermined amount. The gate voltages X and Y (of the transistors) are set so that the NMOS transistor 102 and the PMOS transistor 103 are operated in the saturated region in the operating characteristics of a MOS transistor. This reduces fluctuations in the gate-source voltage of each MOS transistor compared to the fluctuations in source-drain voltage of each MOS transistor. In FIG. 3, each MOS transistor is connected to the power supply lines (power lines) 104 and 105 at the drain terminal thereof. The application of the constant voltages X and Y to each of the MOS transistors suppresses the fluctuation in the gate-source voltage of each of the NMOS transistor 102 and the PMOS transistor 103 even if there is any fluctuation in the voltage at the drain terminal of each MOS transistor. Consequently, the voltage fluctuation at the source terminal of each of the MOS transistors connected to both ends of the heater 101 can be reduced compared to the fluctuation in the voltage at the drain terminal of each MOS transistor.

While the heaters 101 are energized, the fluctuation in the gate-source voltage of each MOS transistor can be suppressed compared to the fluctuation in the source-drain voltage of each MOS transistor even if there is fluctuation in the voltage at the drain terminal of each MOS transistor due to wiring resistance and power supply capability of the power source. Since the voltage across the heater 101 varies depending on the gate voltages X and Y, controlling the voltages X and Y enables the application of a desired voltage to the heater 101. The transistors connected to the heater 101 are in off-state while the heater 101 is not driven. This makes the ends of the heater 101 electrically open, and the power supply to the heater 101 is interrupted.

Figure 8:
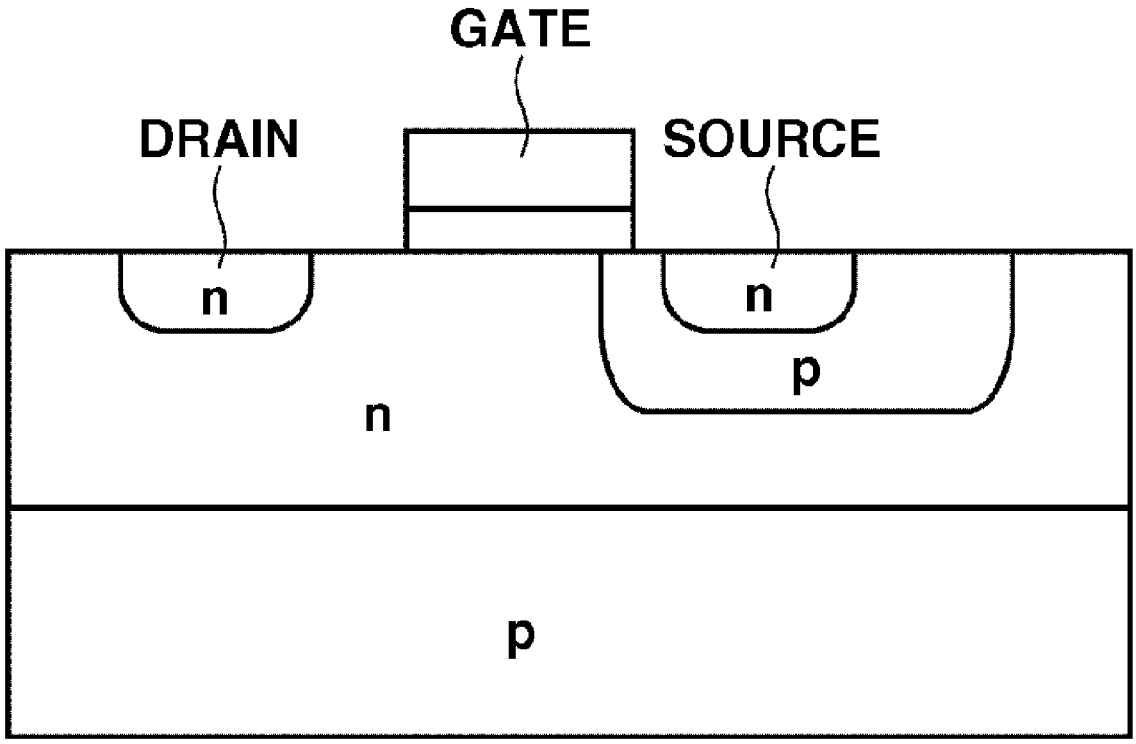
FIG. 8 is a cross sectional view illustrating an NMOS transistor according to a second exemplary embodiment of the present invention.
Figure 9:
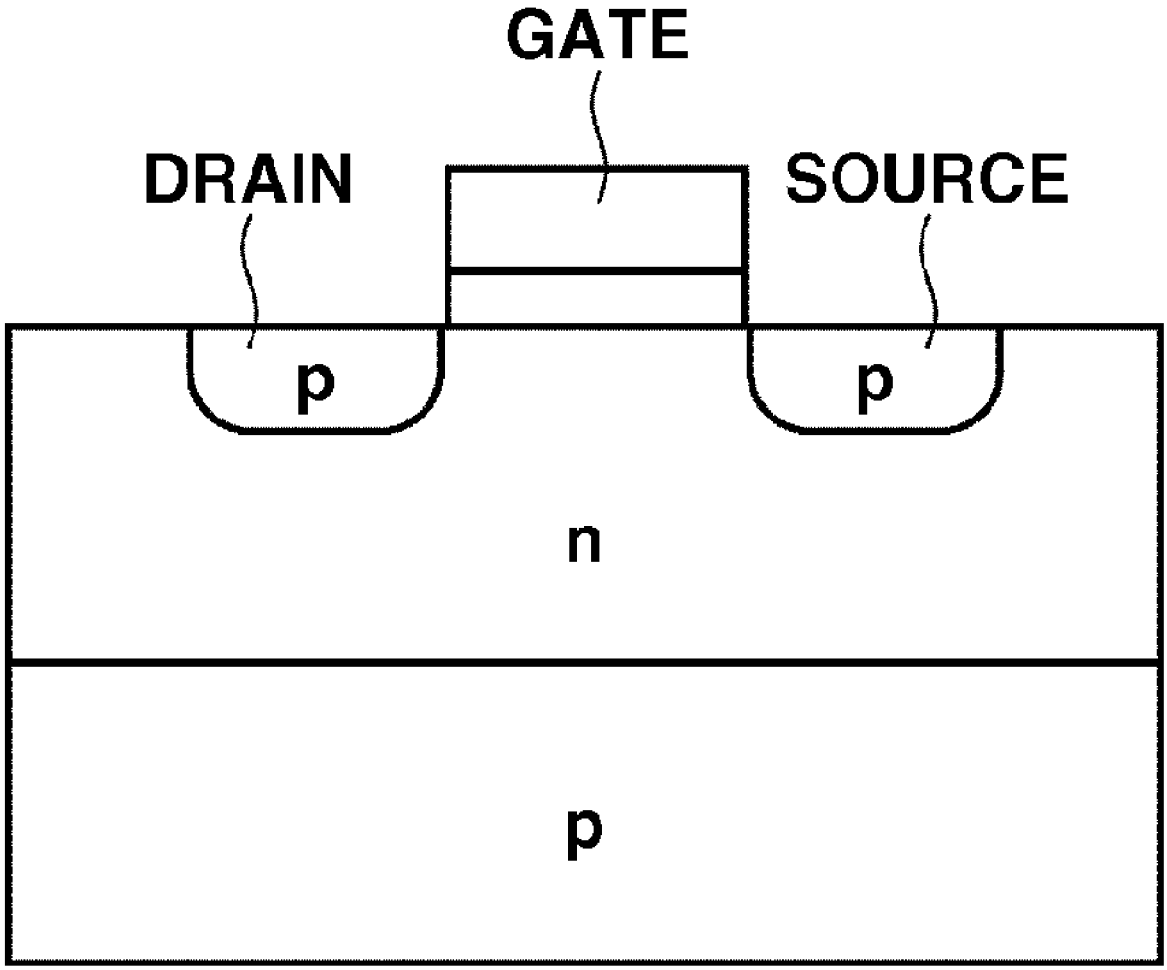
FIG. 9 is a cross sectional view illustrating a PMOS transistor according to the second exemplary embodiment.

FIG. 8 illustrates a cross section of the NMOS transistor 102. FIG. 9 illustrates a cross section of the PMOS transistor 103. In FIG. 8, the conductivity types of a semiconductor are designated by the alphabets n and p: the semiconductor includes a source regions with a p-type diffusion region away from an n-type drain region, which enhances the voltage proof (high voltage proof) property compared to a normal MOS transistor. The PMOS transistor 103 in FIG. 9 has a configuration of a normal MOS transistor.

In a second exemplary embodiment of the present invention, a recording head has a circuit configuration similar to that of the first exemplary embodiment, and the recording element driving circuit illustrated in FIG. 3 is used. As in the first exemplary embodiment, the NMOS transistor 102 and the PMOS transistor 103 are used.

Figure 10:
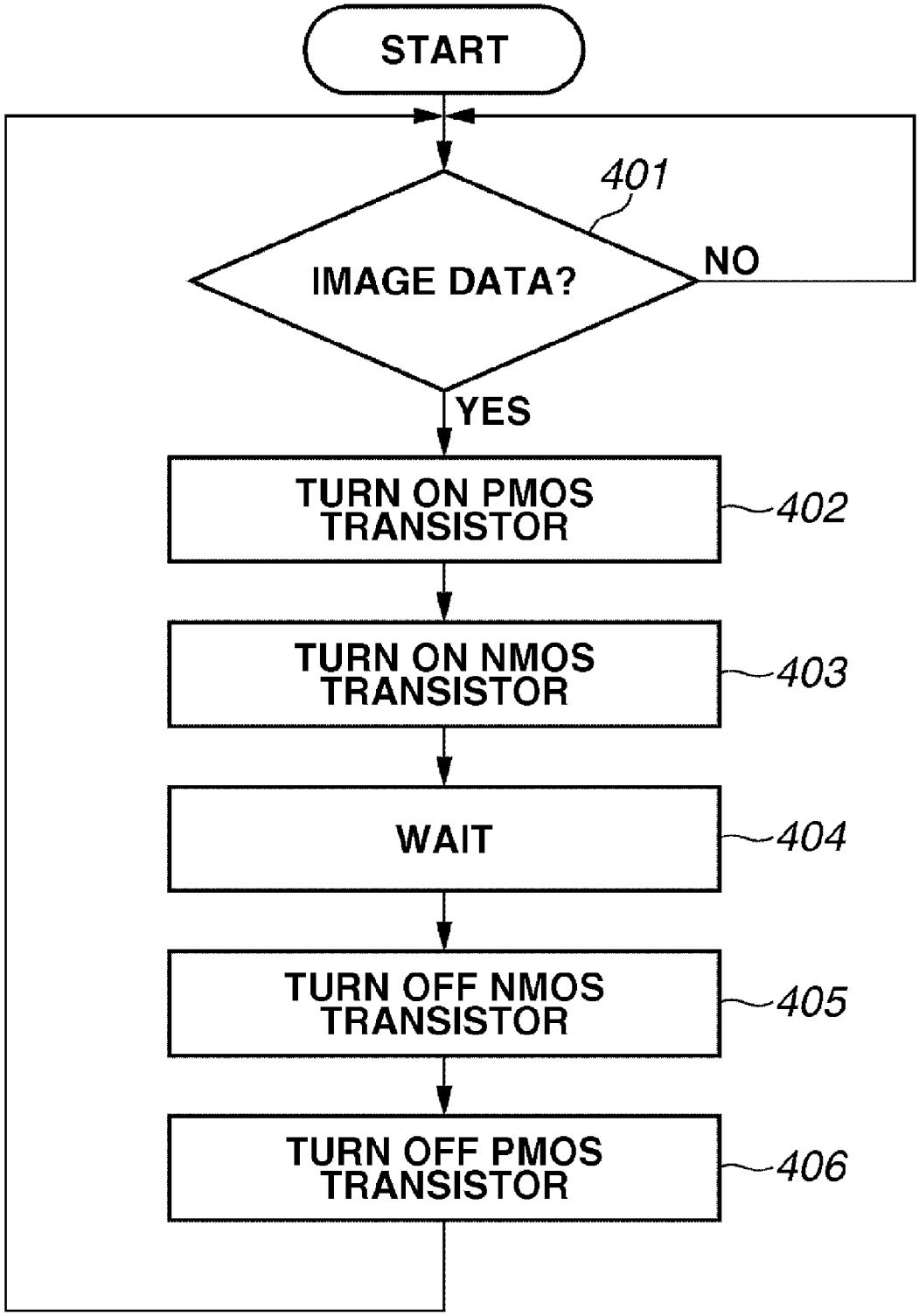
FIG. 10 is a flow chart illustrating operations for driving a heater according to the second exemplary embodiment.

The second exemplary embodiment differs from the first exemplary embodiment in the operation for driving a heater. The operation for driving a heater is described below with reference to the flow chart in FIG. 10 and the timing chart in FIG. 11. FIG. 10 is a flow chart time-sequentially illustrating the operation of the heater 101 and the operations of the NMOS transistor 102 and the PMOS transistor 103 in the circuit illustrated in FIG. 3.

In step 401, the selection circuit 108 determines if there is image data corresponding to a heater to be driven. In step 402, if there is image data corresponding to a heater to be driven (YES in step 402), the selection circuit 108 applies a voltage to the gate of the PMOS transistor 103 via the voltage conversion circuit 107, and turns on the PMOS transistor 103. In step 403, the selection circuit 108 applies a voltage to the gate of the NMOS transistor 102 via the voltage conversion circuit 106, and turns on the NMOS transistor 102. In step 404, the selection circuit 108 waits for a predetermined period of time, resulting in the application of a voltage in response to the wait time to the heater 101 corresponding to the image data. In step 405, the selection circuit 108 turns off the NMOS transistor 102. In step 406, the selection circuit 108 turns off the PMOS transistor 103. The above steps are repeated to drive the heater 101 repeatedly.

Figure 11A:
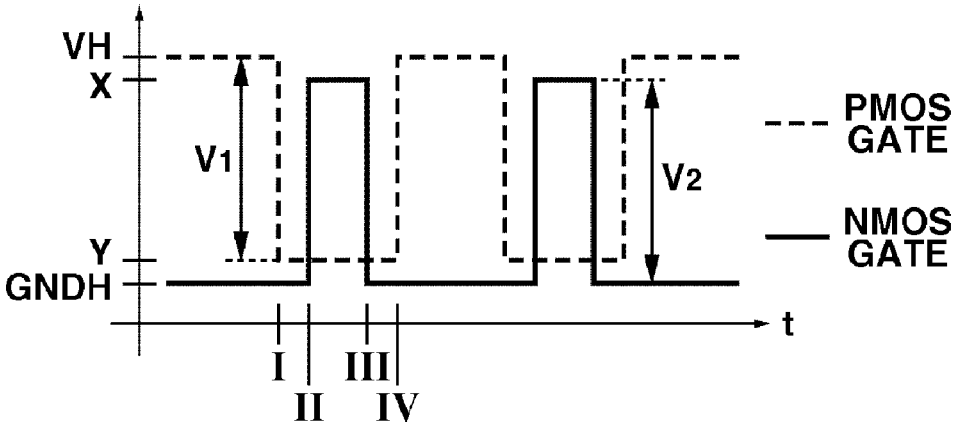
FIGS. 11A to 11C are timing charts illustrating the potentials of heaters and a current applied to a heater according to the second exemplary embodiment.
Figure 11B:
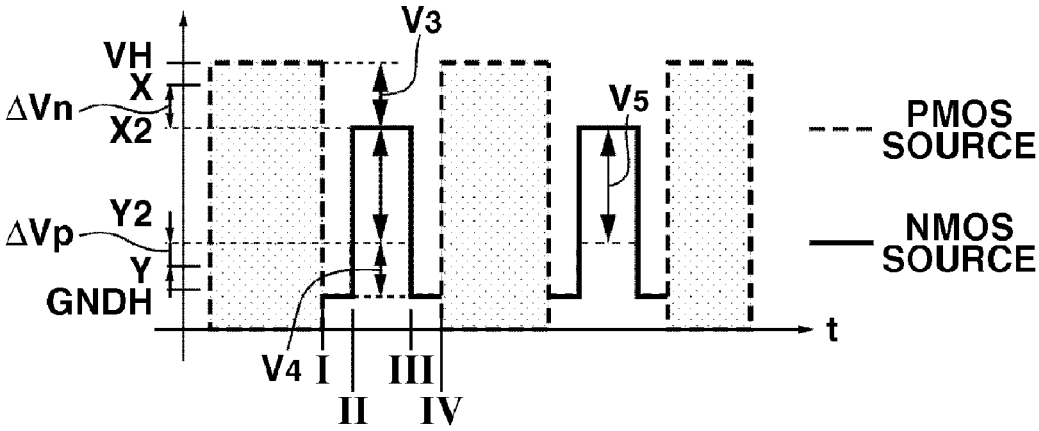
Figure 11C:
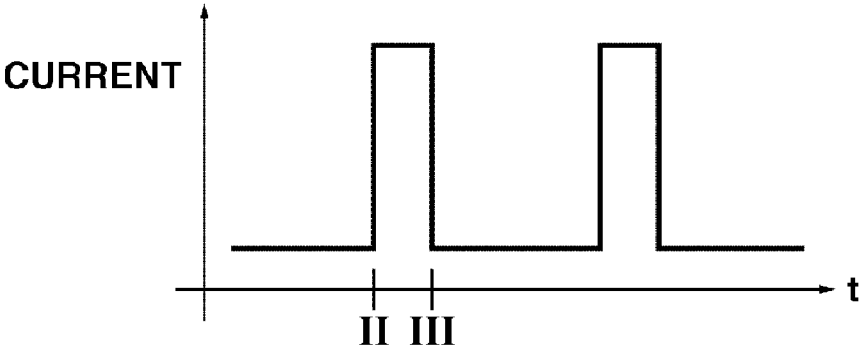

FIG. 11A to 11C are timing charts according to the flow charts in FIG. 10. FIG. 11A illustrates the waveforms of voltages applied to the gates of the NMOS transistor 102 and the PMOS transistor 103. FIG. 11B illustrates the voltage waveforms at the source terminals corresponding to the timings in FIG. 11A. FIG. 11C illustrates the current flowing through the heater 101 corresponding to the timings in FIGS. 11A and 11B.

In FIG. 11A, the waveform of a voltage applied to the gate of the NMOS transistor 102 is illustrated by the solid line, whereas the waveform of a voltage applied to the gate of the PMOS transistor 103 is illustrating by the dashed line. Before the timing I, the NMOS transistor 102 having a gate voltage GNDH and the PMOS transistor 103 having a gate voltage VH are in off-state, and the heater 101 is not driven. After the timing I, a gate voltage Y is applied to turn on the PMOS transistor 103, whereas the NMOS transistor 102 is still in off-state, and as the result of that the heater 101 is not driven. After the timing II, a gate voltage X is applied to turn on the NMOS transistor 102. At the timing II, both of the NMOS transistor 102 and the PMOS transistor 103 are in on-state, which allows a current to flow and drive the heater 101. At the timing III, the NMOS transistor 102 is turned off, and the current flow to the heater 101 is interrupted. Then, at the timing IV, the PMOS transistor 103 is turned off, and the ends of the heater 101 becomes electrically open. The voltages X and Y are set so that the potential difference V1 between the gate voltages Y and VH applied to the PMOS transistor 103 and the potential difference V2 between the gate voltages X and GNDH applied to the NMOS transistor 102 each exceed a threshold voltage required to turn on each transistor, as in the first exemplary embodiment.

The chart in FIG. 11B is described below. Before the timing I, both of the transistors 102 and 103 are in off-state, and the heater 101 is electrically open and disconnected from the power source. At the timing I, the voltage Y is applied to the PMOS transistor 103, but due to the NMOS transistor 102 in off-state, no current flows to the heater 101. The heater 101 has a potential at the GNDH level. At the timing II, both of the transistors 102 and 103 are turned on, and the heater 101 is energized. The voltage across the heater 101 is described below. The voltage X is applied to the gate of the NMOS transistor 102. Accordingly, a voltage X2 smaller than the gate voltage X of the NMOS transistor 102 by a predetermined voltage (ΔVn) is applied to the source of the NMOS transistor 102. The voltage X2 is applied to the terminal of the heater 101 on the NMOS transistor 102 side. The voltage Y is applied to the gate of the PMOS transistor 103, and thereby a voltage Y2 is applied to the source of the PMOS transistor 103, the voltage Y2 being larger than the voltage Y by a predetermined voltage (ΔVp). The voltage Y2 is applied to the heater 101 on the PMOS transistor 103 side. At the timing III, the NMOS transistor 102 is turned off, and the current flow to the heater 101 is interrupted. At the timing IV, the PMOS transistor 103 is turned off, and the heater 101 is electrically disconnected from each power source at both ends thereof. In FIG. 11B, the voltage applied to the heater 101 during the period between the timings II and III is designated by the arrow. A potential difference V3 between the voltage VH and the voltage X2 and a potential difference V4 between the voltage Y2 and the voltage GNDH are set so that the NMOS transistor 102 and the PMOS transistor 103 are each operated in the saturated region in the operating characteristics of the MOS transistor.

FIG. 11C illustrates a waveform of a current flowing through the heaters 101. A current flows to the heater 101 during the period between the timings II and III when both of the transistors 102 and 103 in on-state. The second exemplary embodiment differs from the first exemplary embodiment in the timings for driving the PMOS transistor 103 before and after the heater 101 is driven. Before the NMOS transistor 102 is turned on (before the timing II), the PMOS transistor 103 is turned on (at the timing I), and after the NMOS transistor 102 is turned off (after the timing III), the PMOS transistor 103 is turned off (at the timing IV). In the second exemplary embodiment, only the state of the NMOS transistor 102 is changed and the state of the PMOS transistor 103 is not changed when the actual current flow to the heater is changed (before and after making or interrupting of a current).

Specifically, the circuit is configured so that the turning-on of the PMOS transistor 103 does not permit a current flow to the heater 101 yet until the turning-on of the NMOS transistor 102 permits a current flow to the heater 101. More specifically, for actual current flow to the heater 101, the switches connected the ends of the heater 101 are controlled to be turned on one after another, so that the two transistors 102 and 103 are turned on at different timings from each other. In the second exemplary embodiment, the period of time when the heaters 101 is driven varies depending on the period of time when one of the NMOS transistor 102 and the PMOS transistor 103 is in on-state. The period of time when the other transistor is in on-state is longer than the period of time of the transistor in on-state that determines the time for driving the heater 101.

The source-drain voltage of the NMOS transistor 102 at the timing when a current starts to flow to the heater 101 is smaller than the gate voltage X by a predetermined amount (ΔVn) compared to the voltage VH of the power wiring 104. The source-drain voltage of the PMOS transistor 103 is larger than the gate voltage Y by a predetermined amount (ΔVp) compared to the voltage GNDH of the power wiring 105.

The amount of fluctuation in the source-drain voltage of the PMOS transistor 103 can be suppressed compared to that in the source-drain voltage of the NMOS transistor 102. This is because, in flowing a current to the heater 101, the NMOS transistor 102 that is directly used for switching of the flowing causes a larger amount of amount of fluctuation in voltage. The application of a gate voltage to each MOS transistor at the timings allows the PMOS transistor 103 to have a lower voltage proof property compared to the first exemplary embodiment.

In the first exemplary embodiment, since the PMOS transistor 103 and the NMOS transistor 102 are simultaneously turned on, both of the transistors 102 and 103 may require a high-voltage-proof structure depending on a voltage VH applied to the heater 101. In the second exemplary embodiment, however, the PMOS transistor 103 and the NMOS transistor 102 are turned on at different timings, which can reduce the amount of fluctuation in voltage applied to the PMOS transistor 103. Therefore, the PMOS transistor does not require a high-voltage-proof structure, and can be manufactured in more simple steps at lower cost. Generally, in terms of an area the MOS transistor occupies, a normal MOS transistor is more compact as compared to a high-voltage-proof MOS transistor under the conditions for a similar current. Thus, in the circuit of the second exemplary embodiment, the PMOS transistor 103 occupies a smaller area than that in the circuit of the first exemplary embodiment. The area ratio of the transistor to the entire substrate can be decreased, which leads to a downsizing of the circuit.

The value of the actual voltage applied to the heater 101 falls in the voltage range V5 between the timings II and III in FIG. 11B. The voltage applied to the heater 101 is set to be within the voltage range V5. The setting can be achieved based on the source-drain voltage of the PMOS transistor 103 and the source-drain voltage of the NMOS transistor 102, the transistors being connected to both ends of the heater 101, respectively. Each transistor used in the saturated region in the operating characteristics of the transistor can have a stable voltage.

Figure 12:
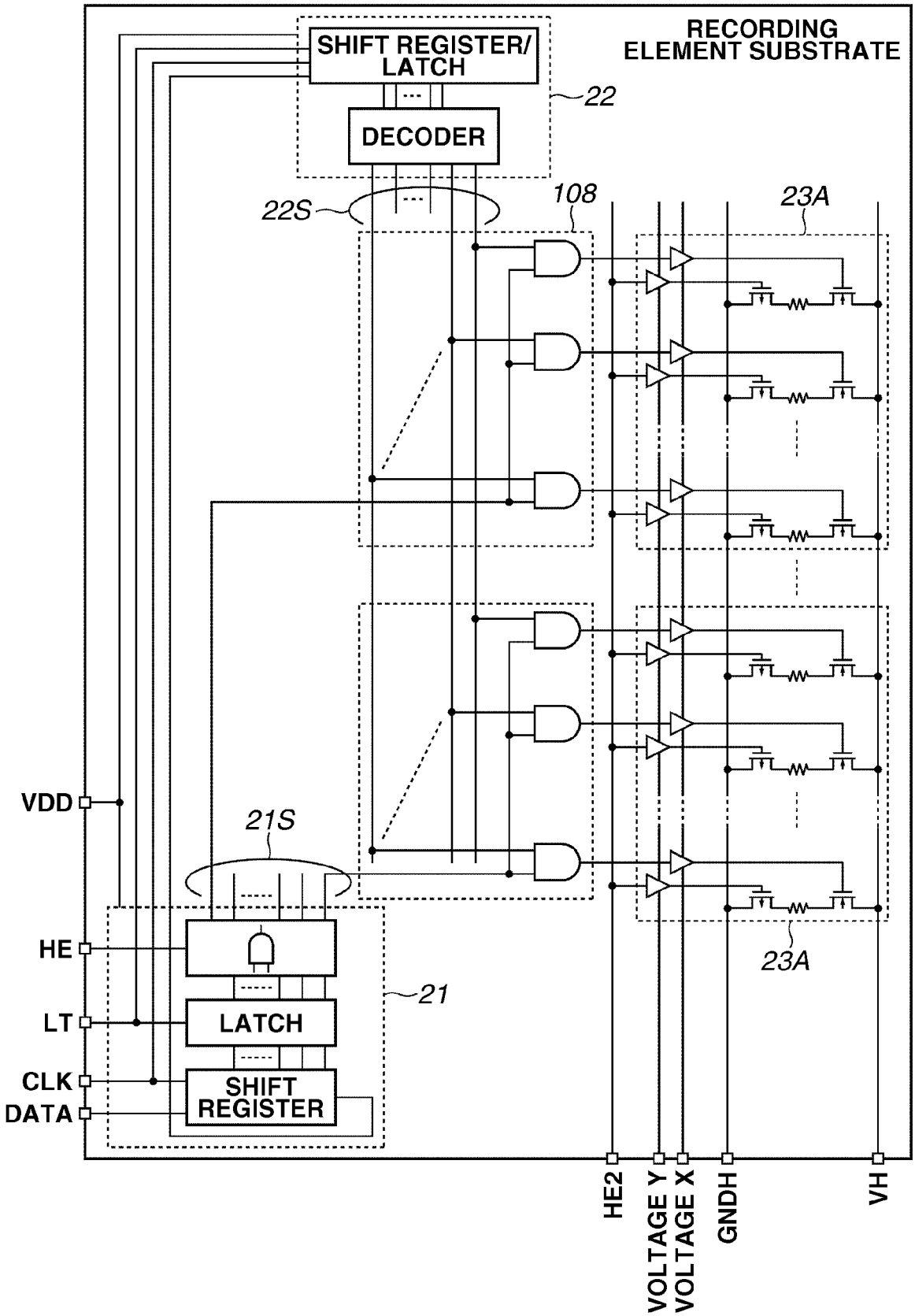
FIG. 12 is a block diagram illustrating a recording element substrate according to a third exemplary embodiment of the present invention.

FIG. 12 is a circuit block diagram illustrating a recording element substrate according to a third exemplary embodiment of the present invention. The third exemplary embodiment differs from the first exemplary embodiment in the configuration of a recording element driving circuit 23A. The record data supply circuit 21 and the block selection circuit 22 have configurations similar to those of the first exemplary embodiment, which will not be described below.

Figure 13:
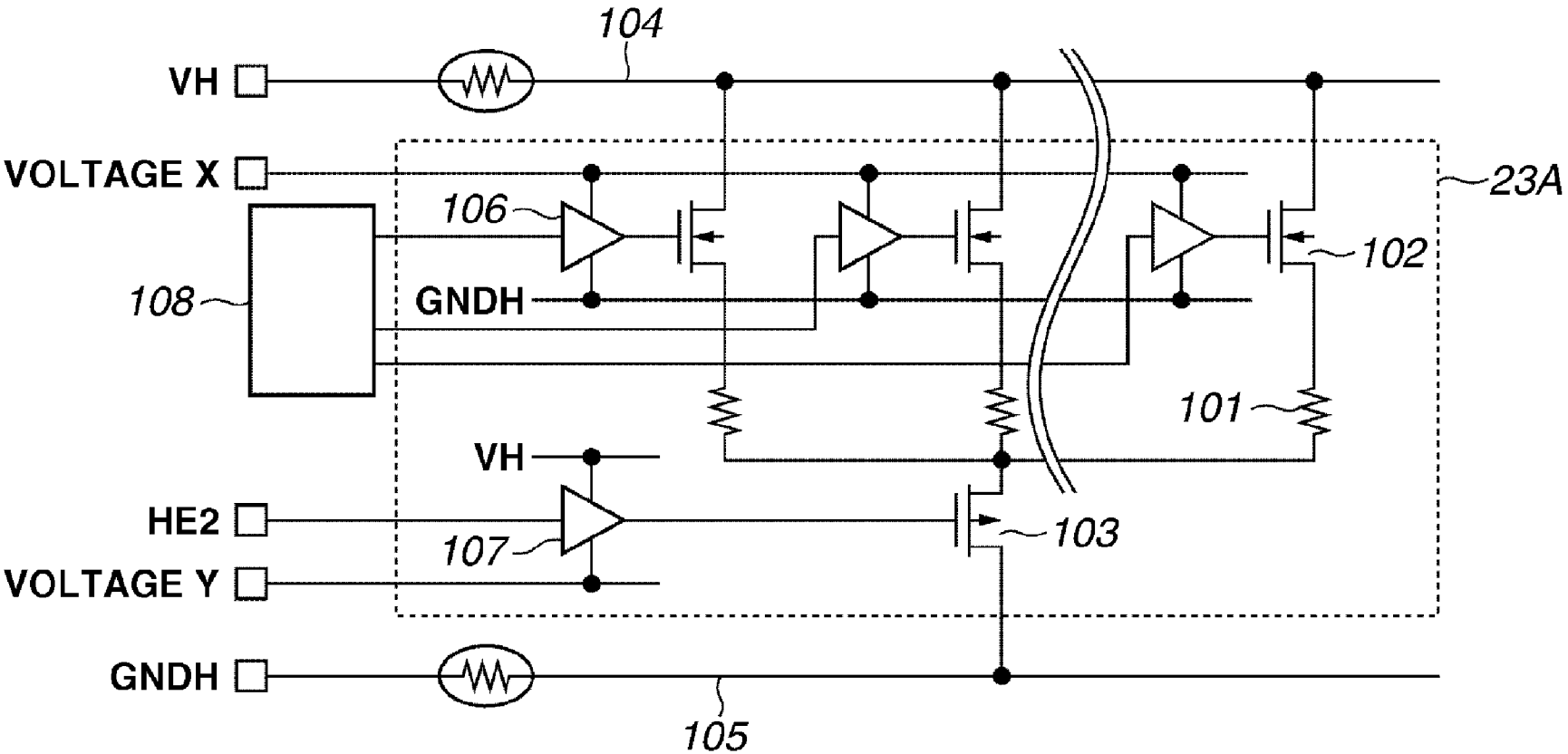
FIG. 13 illustrates a recording element driving circuit according to the third exemplary embodiment.

FIG. 13 illustrates a configuration of the recording element driving circuit 23A in FIG. 12. The recording element driving circuit 23A includes a plurality of heaters 101, NMOS transistors 102 of the same number as that of the heaters, and one PMOS transistor 103. The NMOS transistors 102 are each connected to a voltage conversion circuit 106. The voltage conversion circuit 106 receives a signal from the selection circuit 108, and the voltage conversion circuit 107 receives a signal HE2. The PMOS transistor 103 is connected to the voltage conversion circuit 107. Each of the heaters 101 has one terminal connected to the source terminal of the PMOS transistor 103 using a common wiring. The heaters 101 each have another terminal connected to the source terminal of the NMOS transistor 102. The NMOS transistors 102 each have a gate terminal connected to a respective one of the voltage conversion circuits 106. The voltage conversion circuits 106 are each connected to the terminal for voltages X and GNDH using common wirings. The recording element driving circuit 23A selects one heater, instead of energizing a plurality of heaters simultaneously. Such a configuration can reduce the number of PMOS transistors 103 and the area the circuits occupy. The operations of the NMOS transistor 102 and the PMOS transistor 103 of the third exemplary embodiment are similar to those of the second exemplary embodiment. Thus, the operations of the recording element driving circuit 23A will not be described below.

Figure 14:
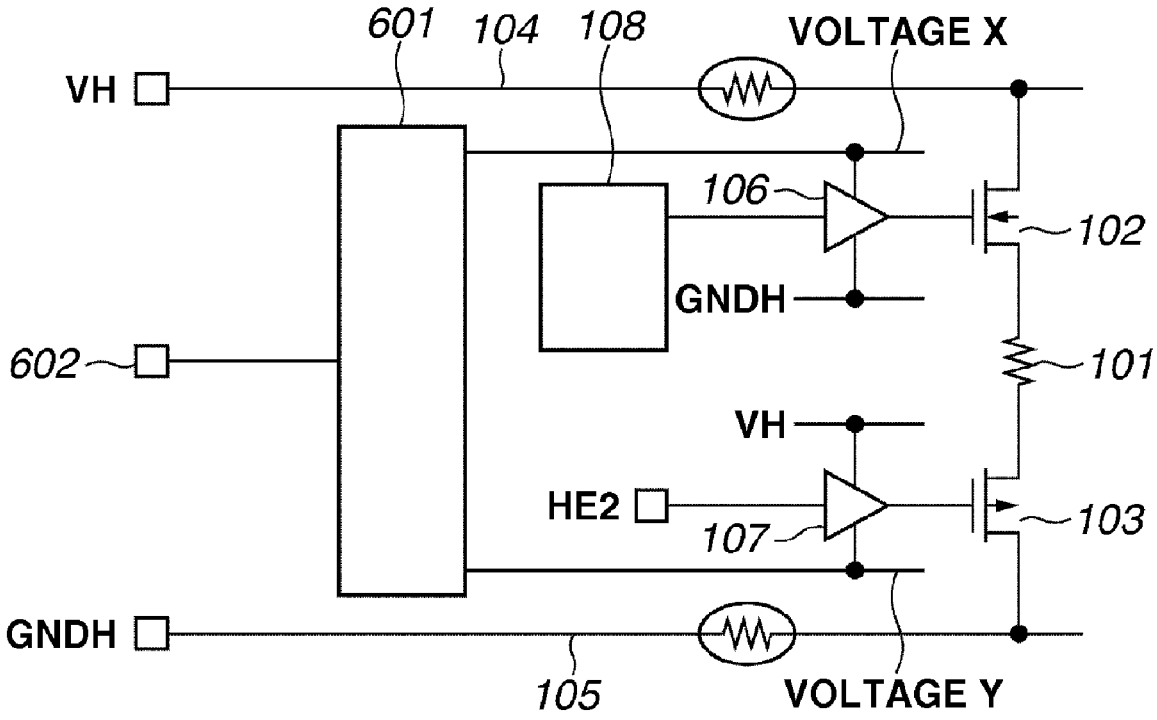
FIG. 14 illustrates a recording element driving circuit according to a fourth exemplary embodiment of the present invention.

FIG. 14 is a circuit block diagram illustrating a recording element substrate according to a fourth exemplary embodiment of the present invention. The fourth exemplary embodiment differs from the first exemplary embodiment in the configuration of the recording element driving circuit 23. The record data supply circuit 21 and the block selection circuit 22 have configurations and operations similar to those of the first exemplary embodiment (FIG. 2), which will not be described below.

As illustrated in FIG. 14, the recording element driving circuit 23 includes a power source circuit 601 that supplies a voltage X and a voltage Y. The power source circuit 601 has a terminal 602 on the recording element substrate, the terminal 602 receiving a reference voltage from an external source.

Figure 15:
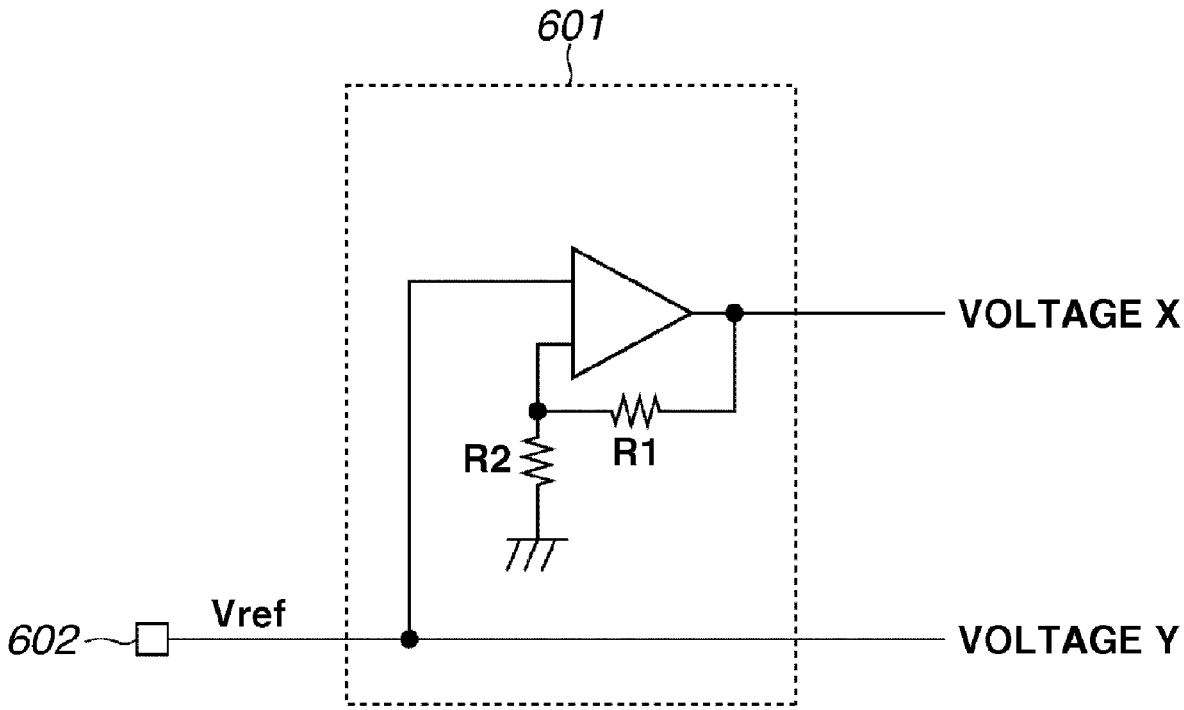
FIG. 15 is a block diagram illustrating a power source circuit according to the fourth exemplary embodiment.

The terminal 602 receives a constant voltage Vref from outside of the recording element substrate. Based on the voltage Vref, the power source circuit 601 on the substrate generates the voltage X and the voltage Y. The voltages X and Y generated in the recording element substrate 1403 from a voltage received from an external source are supplied to the gate of each of the NMOS transistor 102 and the PMOS transistor 103. FIG. 15 illustrates an example of a circuit configuration of the power source circuit 601.

The circuit in FIG. 15 outputs the voltage Vref directly as the voltage Y, and outputs the voltage X based on the following equation:

$$\text{Voltage } X=(R1+R2)/R2*Vref$$

The resistances R1 and R2 are set according to a desired value of the voltage X, so that any voltage can be obtained as needed.

In a fifth exemplary embodiment of the present invention, a drive voltage for a MOS transistor for driving a heater is generated in a recording element substrate. The fifth exemplary embodiment differs from the first exemplary embodiment in the configuration of the recording element driving circuit 23. The record data supply circuit 21 and the block selection circuit 22 have configurations and operations similar to those of the first exemplary embodiment (FIG. 2), which will not be described below.

Figure 16:
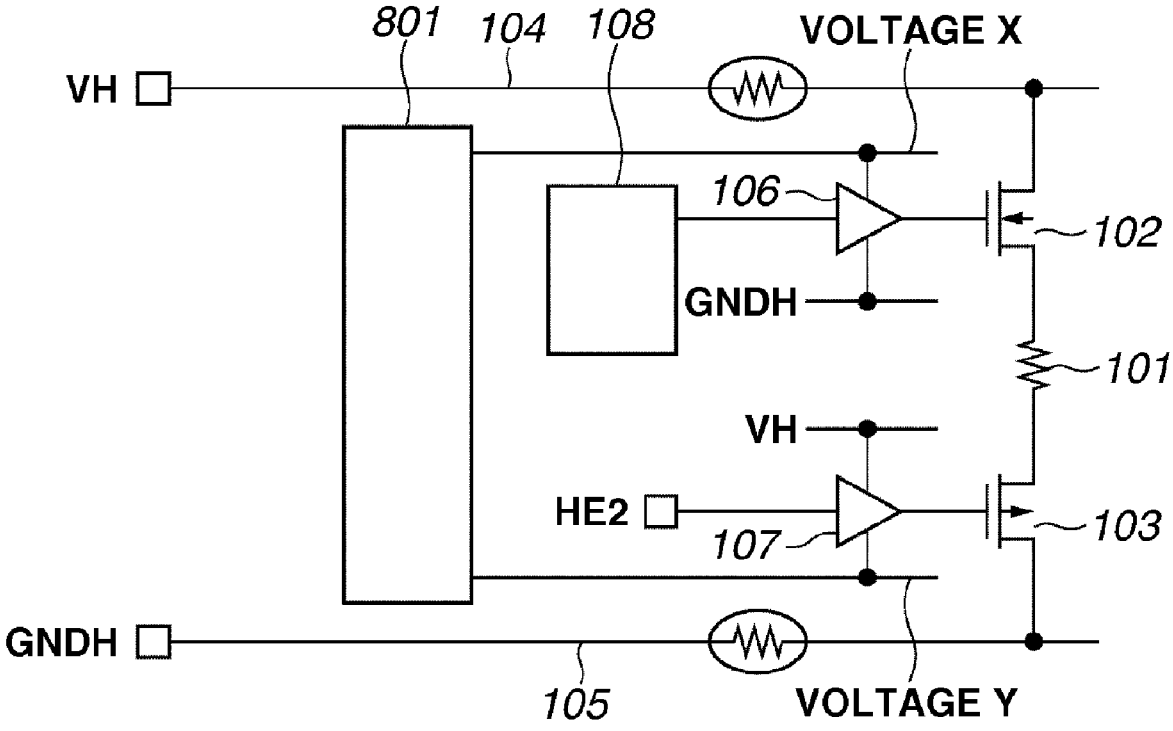
FIG. 16 illustrates a recording element driving circuit according to a fifth exemplary embodiment of the present invention.
Figure 17:
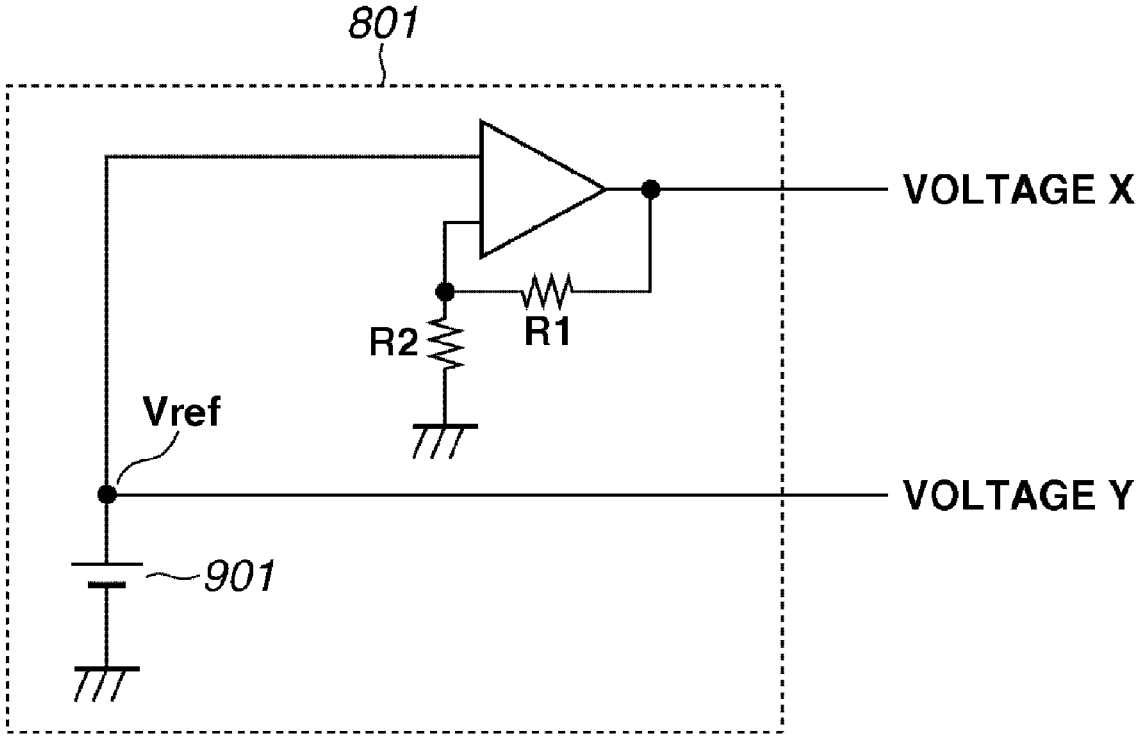
FIG. 17 is a block diagram illustrating a power source circuit according to the fifth exemplary embodiment.
Figure 18:
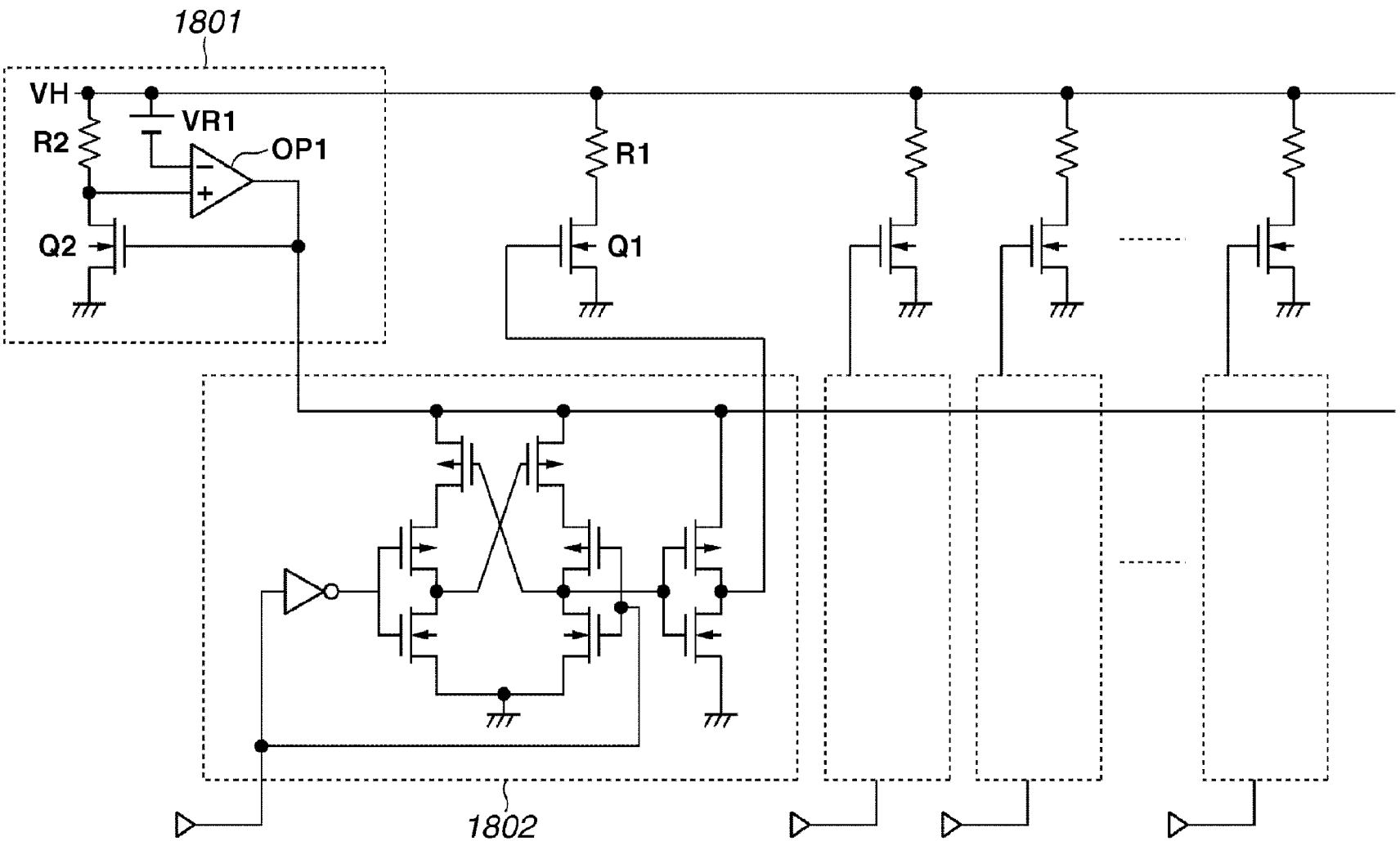
FIG. 18 illustrates a circuit block diagram illustrating a conventional recording element substrate.

In FIG. 16, a power source circuit 801 generates the voltages X and Y. Accordingly, terminals for receiving power from an external source can be omitted. FIG. 17 illustrates an example of a circuit configuration of the power source circuit 801. A voltage generator 901 generates a reference voltage Vref. The voltage X is generated by amplifying the voltage Vref, the voltage Vref being set based on a band gap voltage. This enables the generation of an intrinsic voltage having little variation in manufacturing.

Although the embodiments of the present invention have been described, any circuit configurations that satisfy the above described signal timings other than the circuit that generates signals input to the voltage conversion circuits 106 and 107 may be used. For example, in the circuit configuration illustrated in FIG. 3, the voltage conversion circuit 107 may receive signals from a circuit on a recording element substrate. Alternatively, in the circuit configuration illustrated in FIG. 3, the voltage conversion circuit 106 may receive signals from the controller 1700. Alternatively, in the circuit configuration illustrated in FIG. 3, the voltage conversion circuit 106 may receive signals from the controller 1700, and the voltage conversion circuit 107 may receive signals from the selection circuit 108.

Figure 19:
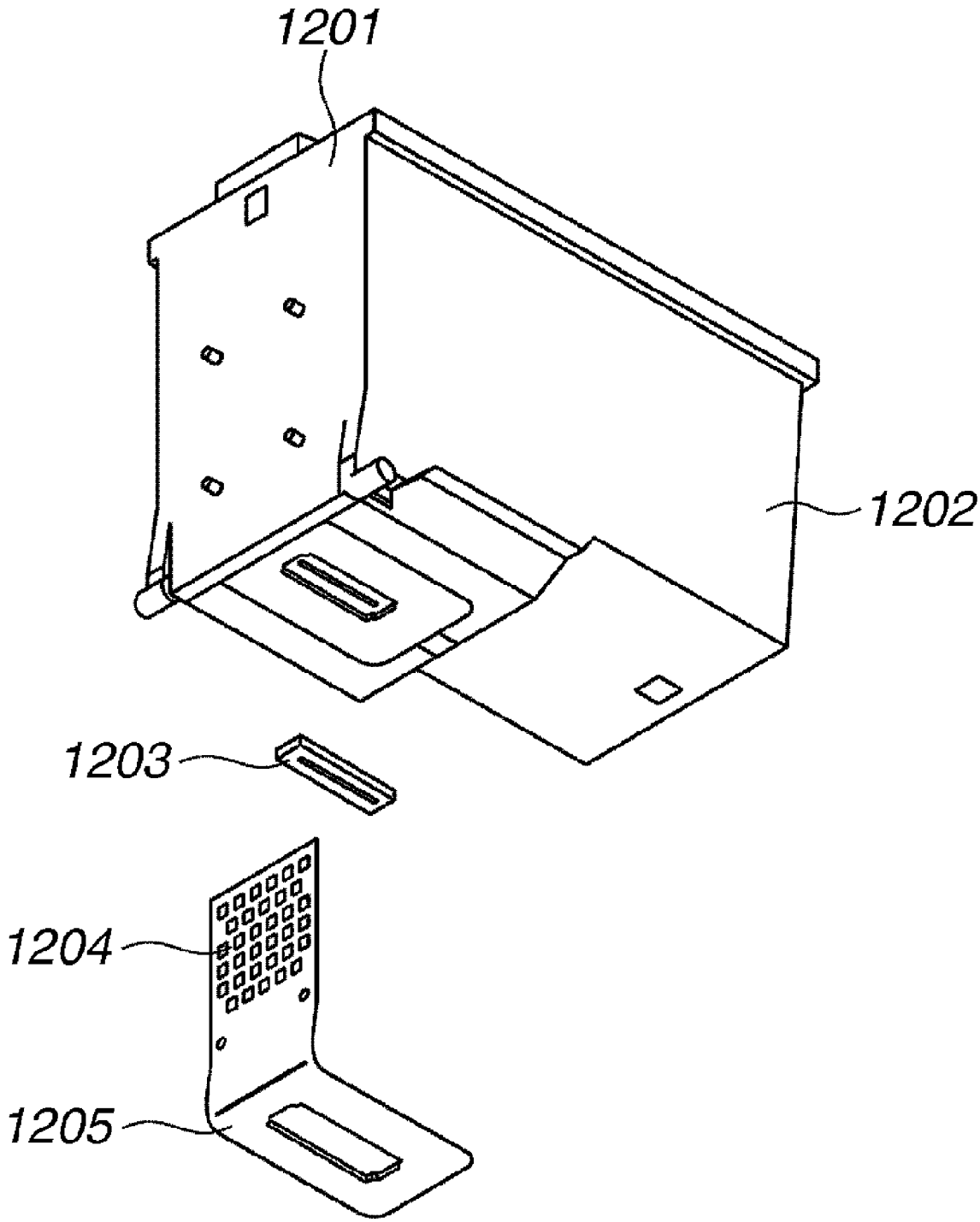
FIG. 19 is a perspective view illustrating a recording head cartridge according to an exemplary embodiment of the present invention.

The present invention is not limited to the above-described recording element substrates, and can be applied to a recording head with such a recording element substrate. Also, the present invention can be applied to a recording head cartridge 1201 having an integrally formed liquid container 1202 for liquids used in recording with the recording head, as illustrated in FIG. 19. FIG. 19 is an external perspective view illustrating a configuration of the recording head cartridge 1201, which is attachable to a recording apparatus in a removable manner. The recording head cartridge 1201 has an electrode pad 1204 that receives electrical signals from the recording apparatus, and the electrical signals are used to drive recording elements on a recording element substrate 1203 for recording. The recording element substrate 1203 is electrically connected to the electrode pad 1204 by a conductive tape automated bonding (TAB) 1205.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2008-306503 filed Dec. 1, 2008, which is hereby incorporated by reference herein in its entirety.

What is claimed is:

1. A recording element substrate comprising:

a recording element;

a first power line configured to supply a first voltage;

a second power line configured to supply a ground voltage;

a first voltage conversion circuit including a first input unit configured to receive a first control signal, and a second input unit configured to receive a second voltage, which is higher than the ground voltage, and the first voltage, and to output the first control signal with an increased amplitude;

a second voltage conversion circuit including a first input unit configured to receive a second control signal, and a second input unit configured to receive a third voltage, which is lower than the first voltage, and the ground voltage, and to output the second control signal with an increased amplitude;

a PMOS transistor having a drain terminal connected to the second power line, a source terminal connected to one end of the recording element, and a gate terminal connected to an output of the first voltage conversion circuit; and an NMOS transistor having a drain terminal connected to the first power line, a source terminal connected to the other end of the recording element, and a gate terminal connected to an output of the second voltage conversion circuit.

2. The recording element substrate according to claim 1, further comprising a second recording element, wherein the source terminal of the PMOS transistor is connected to the recording element and the second recording element.

3. The recording element substrate according to claim 1, wherein the second voltage is set so that a potential difference between the first voltage and the second voltage exceeds a threshold voltage required to turn on the PMOS transistor.

4. The recording element substrate according to claim 1, wherein the third voltage is set so that a potential difference between the third voltage and the ground voltage exceeds a threshold voltage required to turn on the NMOS transistor.

5. The recording element substrate according to claim 1, further comprising:

a first terminal connected to the first power line; and a second terminal connected to the second power line.

6. The recording element substrate according to claim 1, further comprising a control circuit configured to generate at least one of the first control signal and the second control signal.

7. A recording head comprising the recording element substrate according to claim 1.

* * * * *